US009111502B2

(12) United States Patent
Guo

(10) Patent No.: US 9,111,502 B2
(45) Date of Patent: Aug. 18, 2015

(54) DRIVING CIRCUIT AND LCD DEVICE HAVING DATA MONITORING MODULE

(71) Applicant: SHENZHEN CHINA STAR OPTOELECTRONICS TECHNOLOGY CO., LTD, Shenzhen (CN)

(72) Inventor: Dongsheng Guo, Shenzhen (CN)

( * ) Notice: Subject to any disclaimer, the term of this patent is extended or adjusted under 35 U.S.C. 154(b) by 288 days.

(21) Appl. No.: 13/807,283

(22) PCT Filed: Dec. 7, 2012

(86) PCT No.: PCT/CN2012/086100
§ 371 (c)(1),
(2) Date: Dec. 27, 2012

(87) PCT Pub. No.: WO2014/082329
PCT Pub. Date: May 6, 2014

(65) Prior Publication Data

US 2014/0152645 A1 Jun. 5, 2014

(30) Foreign Application Priority Data

Nov. 30, 2012 (CN) ..... 2012 1 0501308

(51) Int. Cl.
*G09G 3/36* (2006.01)

(52) U.S. Cl.
CPC ..... *G09G 3/3648* (2013.01); *G09G 3/3677* (2013.01); *G09G 2310/0205* (2013.01); *G09G 2310/067* (2013.01)

(58) Field of Classification Search
CPC ..... G09G 3/3648; G09G 2310/067; G09G 2310/0205; G09G 3/3677
USPC ..... 345/87, 98, 214
See application file for complete search history.

(56) References Cited

U.S. PATENT DOCUMENTS

| | | | | |
|---|---|---|---|---|
| 2005/0041006 | A1* | 2/2005 | Lee et al. | 345/99 |
| 2007/0008263 | A1* | 1/2007 | Kim | 345/87 |
| 2007/0097057 | A1* | 5/2007 | Shin | 345/98 |
| 2009/0295779 | A1* | 12/2009 | Yanagi et al. | 345/213 |
| 2011/0169793 | A1 | 7/2011 | Chen et al. | |

FOREIGN PATENT DOCUMENTS

| | | | |
|---|---|---|---|
| CN | 1655224 | A | 8/2005 |
| CN | 101127199 | A | 2/2008 |
| CN | 101202024 | A | 6/2008 |
| CN | 101399020 | A | 4/2009 |
| CN | 101620841 | A | 1/2010 |
| CN | 102054444 | A | 5/2011 |
| CN | 202008813 | U | 10/2011 |

OTHER PUBLICATIONS

Wang Chao, the International Searching Authority written comments, Aug. 2013, CN.

* cited by examiner

*Primary Examiner* — Jonathan Blancha

(57) ABSTRACT

A driving method of a liquid crystal display (LCD) panel comprises a scan driving process and a data driving process. In the scan driving process, overlapping time regions are formed simultaneously between a positive edge and a negative edge of the scan lines when a drive of a last row of a scan line is switched to drive of a next row of the scan line. In the data driving process, when a time of data signal corresponding to the last row of the scan line overlaps a time of the overlapping time regions, the data signal corresponding to the next row of the scan line are outputted.

4 Claims, 2 Drawing Sheets

"Prior Art"

"Prior Art"

DRIVING CIRCUIT AND LCD DEVICE HAVING DATA MONITORING MODULE

TECHNICAL FIELD

The present disclosure relates to the field of a liquid crystal display (LCD), and more particularly to a driving method of an LCD panel, a driving circuit and an LCD device.

BACKGROUND

A liquid crystal display (LCD) panel includes scan lines and data lines that cross each other. The data lines are controlled by a data driving chip. When the data driving chip receives a data activating signal TP1 (latched pulse), the data driving chip outputs a data voltage to the data lines of the LCD panel at a negative edge of the TP1. The scan lines are controlled by a scan driving chip arranged on two sides of the LCD panel. Currently, the scan driving chip that controls a positive edge and negative edge of each scan line of an LCD requires three control signals: a start pulse signal STV (start voltage pulse) that controls a start of a first scan line, a clock pulse signal CKV (clock voltage pulse) that is sent a shift register of the scan driving chip to control switching frequency of each of the scan lines and start to act when the STV is detected to be at a high level at a positive edge of the STV, and an output enable control signal OE (output enable). Because the LCD panel comprises a parasitic capacitor, scan output voltage (out) is delivered into the LCD panel, which causes a time delay. Because of the time delay, there is a time delay between the positive edge and the negative edge of the scan lines, thus forming, an overlapping, time region between the positive edge and the negative edge of the scan lines, which makes data signals of the data lines be in the wrong position (as shown in FIG. 1). Because the OE is at a high level, output voltage is forced to be reduced, if the OE is arranged between the positive edge and negative edge of the scan lines, adjacent scan lines are forced without forming simultaneously overlapping time regions, which avoids overlapping opening time of two lines and making the data signals of the data lines be in the wrong position, as shown in FIG. 2.

The control signals of the scan driving chip are transmitted to a glass of the LCD panel by a printed circuit board assembly (PCBA) via a flexible circuit board of the data driving chip, then transmitted to the scan driving chip by a glass cabling. Currently, a main design of the LCD panel is developed towards a narrow frame, however adding a signal is that one more wire is cabled on the glass, which occupies space of an edge of the glass makes a sequence control chip T-CON (timing controller) need one more control signal and increases cost.

SUMMARY

In view of the above-described problems, the aim of the present disclosure is to provide a driving method of a liquid crystal display (LCD) panel, a driving circuit and an LCD device capable of reducing cabling of an LCD panel and reducing the cost.

The aim of the present disclosure is achieved by the following technical scheme.

A driving method of an LCD panel comprises a scan driving process and a data driving process, wherein in the scan driving process, simultaneously forming overlapping time regions between a positive edge and a negative edge of the scan lines when drive of a last row of a scan line is switched to drive of a next row of the scan line. In the data driving process, a when a time of data signal corresponding to the last row of the scan line overlaps a time of the overlapping time regions, the data signal corresponding to the next row of the scan line are outputted.

Furthermore, the data driving process comprises:

A. starting to time when the drive of the last row of the scan line is switched to the drive of the next row of the scan line;

B. presetting a delay time; outputting a data activating signal when the time reaches the delay time, wherein sum of the delay time and the duration time of the data activating signal is not less than the time of the overlapping time regions;

C. outputting the data signal corresponding to the next row of scan line via a trigger of the data activating signal.

In the technical scheme, the purpose of the present disclosure is achieved only by regulating the time sequence of the typical data activating signal TP1, with low development difficulty.

Furthermore, the step B comprises the sum of the delay time and the duration time of the data activating signal is equal to the time of overlapping time regions. The step C comprises: outputting data line driving signals at a negative edge of the data activating signal. In the technical scheme, data output is triggered at the negative edge so as to ensure that the data signal is outputted when data signal just exceeds the overlapping time regions. Thus, on the premise of preventing the data signal from overlapping in the overlapping time regions, the duration time of the data signal is supported to the largest degree. As a result, LC molecules have more time to deflect and keep corresponding angles to ensure display quality.

Furthermore, the step B comprises: the delay time is not less than sustained time of the overlapping time regions. The step C comprises: outputting data line driving signals at a positive edge of the data activating signal. In the technical scheme, data output is triggered at the positive edge so as to ensure that the data signal is outputted when the data signal just exceeds the overlapping time regions. Thus, on the premise of preventing the data signal from overlapping in the overlapping time regions, the duration time of the data signal is supported to the largest degree. As a result, LC molecules have more time to deflect and keep corresponding angles to ensure display quality.

Furthermore, the step B comprises: the delay time is not less than that of the overlapping time regions. The step C comprises: outputting data line driving signals at the negative edge of the data activating signal. In the technical scheme, data output is triggered at the negative edge. The data signal is outputted when the data signal is larger than the overlapping time regions. Thus, the overlapping possibility of the data signal in the overlapping time regions is avoided, and control reliability is improved.

Furthermore, the step A comprises: outputting a start pulse signal, outputting a clock pulse signal, driving the last row of the scan line at a positive edge of a previous clock pulse signal, ending the drive of the last row of the scan line at a positive edge of the next row of the clock pulse signal, then driving the next row of the scan line. This is a specific driving method of the scan lines.

Furthermore, the scan driving process comprises: outputting a clock pulse signal, driving the last row of the scan line at a positive edge of a previous clock pulse signal, ending the drive of the last row of the scan line at a positive edge of the next row of the clock pulse signal, then driving the next row of the scan line. This is a specific scan driving process.

The step B of the data driving process comprises: the sum of the delay time and the duration time of the data activating signal is equal to the time of the overlapping time regions.

The step C of the data driving process comprises: outputting data line driving signals at a negative edge of the data activating signal.

This is a specific driving method of scan lines and data lines.

A driving circuit of an LCD panel comprises scan lines, scan driving chips coupled with the scan lines, data lines, and data driving chips coupled with the data lines. Overlapping time regions are formed when the data driving chips switch the drive of the last row of scan line to the drive of the next row of scan line. The driving circuit of the LCD panel further comprises a data monitoring module for outputting data signal corresponding to the next row of scan line when a time of the data signal corresponding to the last row of the scan line overlaps a time of the overlapping time regions.

Furthermore, the data monitoring module comprises a detection module, a control module and a timing module that presets a delay time. When the detection module detects that the drive of the last row of the scan line is switched to the drive of the next row of the scan line by the scan driving chips, the timing module starts to time. When the time reaches the delay time, the control module outputs the data activating signal. The data chips are controlled to drive the corresponding data lines. The sum of the delay time and the duration time of the data activating signal is not less than the time of the overlapping time regions. This is a specific data monitoring module circuit. Thus, the purpose of the present disclosure is achieved only by regulating the time sequence of the typical data activating signal TP1, with low development difficulty.

Furthermore, the sum of the delay time of the timing module and the duration time of the data activating signal is equal to the time of overlapping time regions. The data driving chips output data line driving signals at the negative edge of the data activating signal. In the technical scheme, data output is triggered at the negative edge so as to ensure that the data signal is outputted when data signal just exceeds the overlapping time regions. Thus, on the premise of preventing the data signal from overlapping in the overlapping time regions, the duration time of the data signal is supported to the largest degree. As a result, LC molecules have more time to deflect and keep corresponding angles to ensure display quality.

Furthermore, the delay time of the timing module is not less than the time of the overlapping time regions. The data driving chips output data line driving signals at the positive edge of the data activating signal. In the technical scheme, data output is triggered at the positive edge so as to ensure that the data signal is outputted when the data signal just exceeds the overlapping time regions. Thus, on the premise of preventing the data signal from overlapping in the overlapping time regions, the duration time of the data signal is supported to the largest degree. As a result, LC molecules have more time to deflect and keep corresponding angles to ensure display quality.

An LCD device comprises a driving circuit of an LCD panel mentioned above.

The inventor finds through study that the effect of an output enable control signal OE in the prior art is that the drive of the last row of the scan line is at the negative edge of the scan line in advance and the drive of the next row of the scan line is delayed at the positive edge of the scan line so that adjacent scan lines are forced without forming simultaneously overlapping time region. The time of the effect of the OE is wasteful. In fact, if a data driving voltage of the overlapping time regions is always a voltage of as last row of the data line, the data signal of the last row of the data line is not covered by a driving voltage of a next row of the data line. When the last row of the scan line is really at the negative edge, the corresponding data signal of the second row of the scan line are sent, which avoids making the data signals of the data lines be in the wrong position. Time point of outputting the data can be regulated by the data activating signal. Thus, in the present disclosure, when a time of data signal corresponding to the last row of the scan line overlaps a time of the overlapping time regions, the data signal corresponding to the next row of scan line are outputted. Thus, the data signal of the last row of the scan line is preloaded at the next row of the overlapping time regions. However, after the data signal exceeds the overlapping time regions, the data signal of the last row of the scan line is restored to correct data signal of the next row of the scan line which cannot affect display of the LCD panel, avoids switching the data driving voltage in the overlapping time regions and a making the data signal of the data lines be in the wrong position, and makes charging time added to the OE be the same as charging time without the OE. Thus, the signal of the OE is saved. The present disclosure reduces the cabling of the LCD panel, decreases the corresponding control signals, reduces design difficulty, correspondingly reduces specification of the control chips required, and reduces cost. In addition, data signal of the last row of the scan line is preloaded firstly at the next row of the overlapping time regions, and liquid crystal (LC) molecules deflect. When the data signal of the next row of the scan line arrives, the LC molecules are regulated slightly based on the original deflection, which increases response speed of the LC molecules and effective time of the display of each row, and make display be more authentic and smoother.

DETAILED DESCRIPTION

Figure 1:
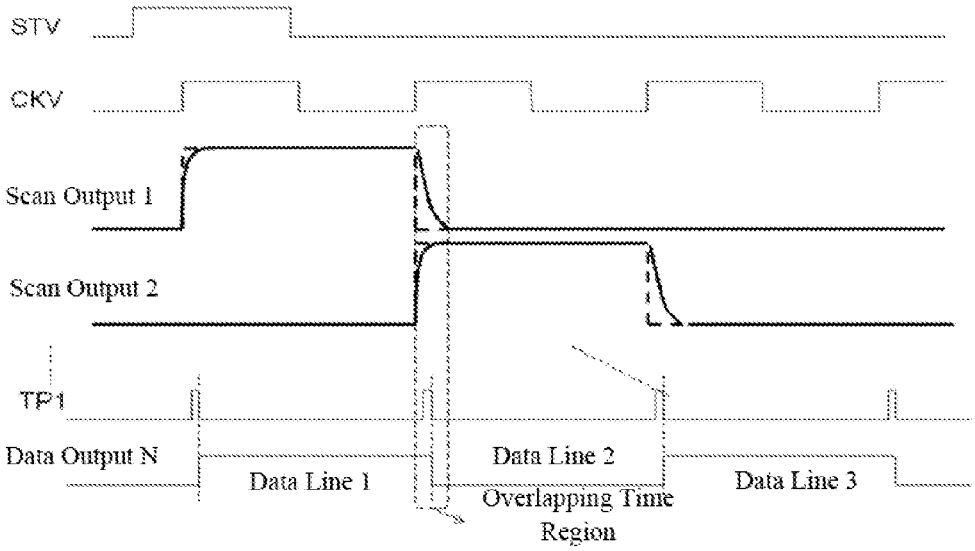
FIG. 1 is a schematic diagram of a driving waveform without OE in the prior art.
Figure 2:
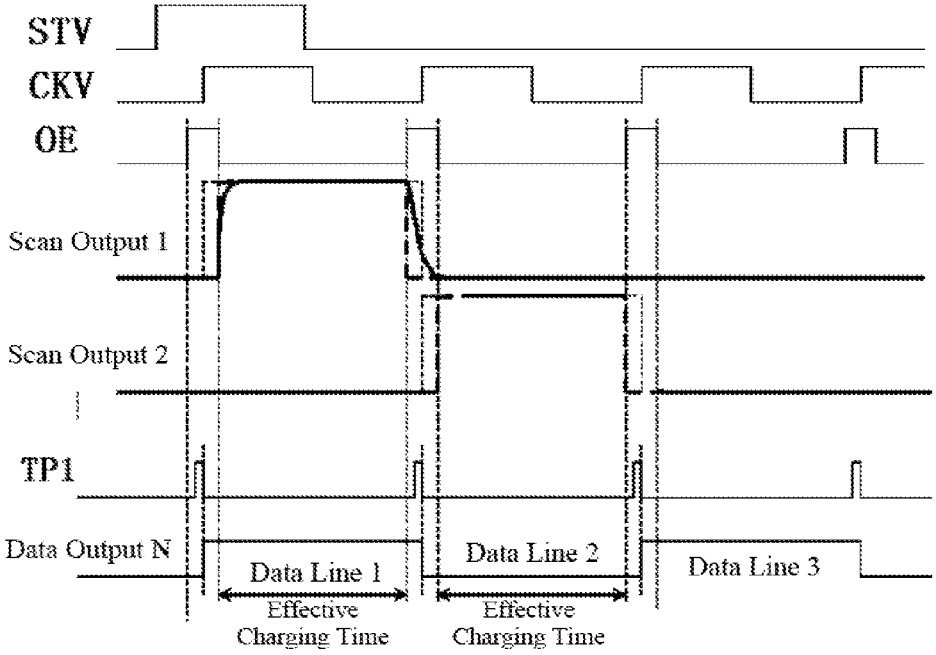
FIG. 2 is a schematic diagram of a driving waveform with OE in the prior art.

The present disclosure discloses a driving method of a liquid crystal display (LCD) panel, a driving circuit using the method, and an LCD device. The driving method of an LCD panel comprises a scan driving process and a data driving process, where in the scan driving process, overlapping time regions between a positive edge and a negative edge of the scan lines are simultaneously formed when drive of a last row of a scan line is switched to drive of a next row of the scan line. In the data driving process, when a time of data signal corresponding to the last row of the scan line overlaps a time of the overlapping time regions, data signal corresponding to the next row of the scan line are outputted.

The inventor finds that effect of an output enable control signal OE in the prior art is that the drive of the last row of the scan line is at the negative edge of the scan line in advance and the drive of the next row of scan line is delayed at the positive edge of the scan fine so as to avoid the overlapping time regions. Time of the overlapping time regions is wasteful. In fact, if a data driving voltage of the overlapping time regions is always a voltage of a last row of the data line, data signal of the last row of data line is not covered by a data driving voltage of a next row of the data line. When the last row of the scan line is really at the negative edge, the corresponding data signal of the second row of the scan line are sent, which avoids making the data signal of the data lines be in the wrong position. Time point of outputting the data can be regulated by the data activating signal. Thus, in the present disclosure, when a time of data signal corresponding to the last row of the scan line overlaps a time of the overlapping time regions, data signal corresponding to the next row of the scan line are outputted. Thus, the data signal of the last row of the scan line is preloaded at the next row of the scan line in the overlapping time regions. However, after data signal exceeds the overlapping time regions, the data signal of the last row of the scan line is restored to correct data signal of the next row of the scan line which cannot affect display of the LCD panel, avoids switching the data driving voltage in the overlapping time regions and making the data signal of the data lines be in the wrong position, and makes charging time added to the OE be the same as charging time without the OE. Thus, signal of the OE is saved. The present disclosure reduces cabling of the LCD panel, decreases corresponding control signals, reduces design difficulty, correspondingly reduces specification of the control chips, and reduces cost. In addition, data signal of the last row of the scan line is preloaded firstly at the next row in the overlapping time regions, and liquid crystal (LC) molecules deflect. When the data signal of the next row of the scan line arrives, the LC molecules are regulated slightly based on the original deflection which increases response speed of the LC molecules and effective time of the display of each row, and make display be more authentic and smoother.

The present disclosure is further described in detail in accordance with the figures and the examples.

Figure 3:
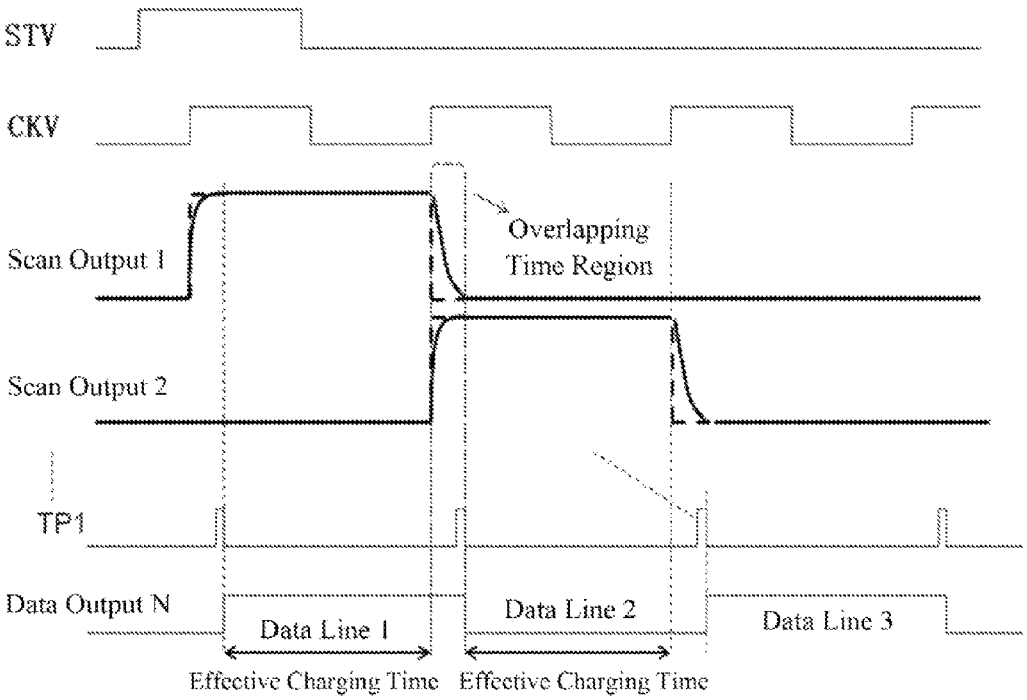
FIG. 3 is a schematic diagram of a driving waveform of an example of the present disclosure.

As shown in FIG. 3, a driving method of an LCD panel comprises a scan driving process and a data driving process. The scan driving process comprises: outputting a start pulse signal STV, outputting a clock pulse signal CKV, driving the last row of the scan line at the positive edge of a last low of the clock pulse signal, ending the drive of the last row of the scan line at a positive edge of a next row of the clock pulse signal, and driving the next row of the scan line.

The data driving process comprises:

A. starting to time when the drive of the last row of the scan line is switched to the drive of the next row of the scan line;

B. presetting a delay time, outputting a data activating signal TP1 when the time reaches the delay time, where sum of the delay time and duration time of the data activating signal TP1 is equal to time of the overlapping time regions;

C. outputting data line driving signals at the negative edge of the data activating signal TP1.

In the technical scheme, data signal output is triggered at the negative edge so as to ensure that the data signal are outputted when the data signal just exceeds the overlapping time regions. Thus, on the premise of preventing the data signal from overlapping in the overlapping time regions, the duration time of the data signal is supported to largest degree. As a result, the LC molecules have more time to deflect and keep corresponding angles, to improve display quality.

Optionally, the example can also have other alternatives.

Alternative Scheme 1

With other steps unchanged, the step B comprises: the delay time is not less than the time of the overlapping time regions. The step C comprises: outputting data line driving signals at the positive edge of the data activating signal. In the alternative scheme, the data signal output is triggered at the positive edge so as to ensure that the data signal is outputted when the data signal just exceeds the overlapping time regions. Thus, on the premise of preventing the data signal from overlapping in the overlapping time regions, the duration time of the data signal is supported to largest degree. As a result, the LC molecules have more time to deflect and keep corresponding angles, to improve display quality.

Alternative Scheme 2

With other steps unchanged, the step B comprises: the delay time is not less than the time of the overlapping time regions. The step C comprises: outputting data line driving signals at the negative edge of the data activating signal. In the alternative scheme, data output is triggered at the negative edge. The data signal is outputted when the data signal exceeds the overlapping time regions the overlapping time regions, which avoids the overlapping of the data signal in the overlapping time regions, and improves control reliability.

Figure 4:
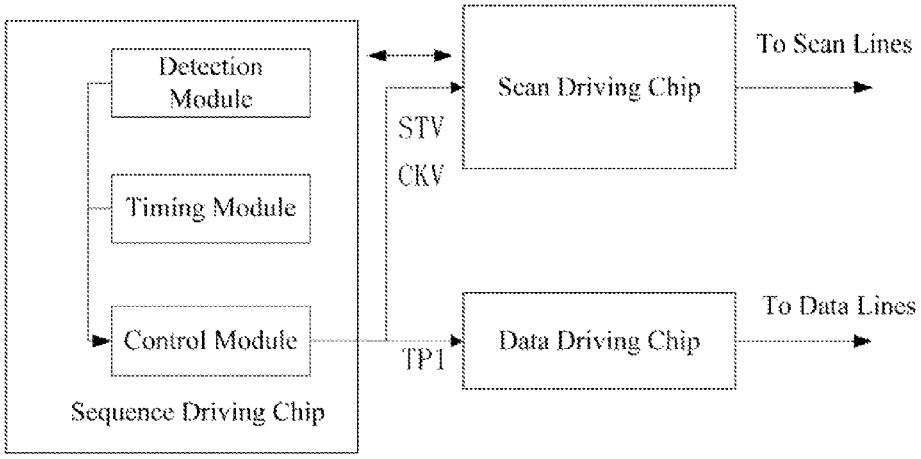
FIG. 4 is a schematic diagram of a driving circuit of a liquid crystal display (LCD) panel of an example of the present disclosure.

As shown in FIG. 4, the present disclosure also discloses a driving circuit of an LCD pane comprising scan lines, a scan driving chip coupled to the scan lines, data lines, and a data driving chip coupled to the data lines. Overlapping time regions are formed simultaneously when the data driving chip switches a drive of a last row of a scan line to a drive of a next row of the scan line. The driving circuit of the LCD panel further comprises a data monitoring module that outputs data signal corresponding to the next row of scan line when a time of data signal corresponding to the last row of the scan line overlaps a time of the overlapping time regions, data signal corresponding to the next row of the scan line are outputted.

The data monitoring module comprises a detection module, a control module and a timing module that presets a delay time. When the detection module detects that the drive of the last row of the scan line is switched to the drive of the next row of the scan line by the scan driving chip, the timing module starts to time. When the time reaches the delay time, the control module outputs a data activating signal. The data driving chip is controlled to drive the corresponding data lines. Sum of the delay time and the duration time of the data activating signal is not less than the time of the overlapping time regions.

The data monitoring module can use a typical sequence control chip. The detection module, the timing module, and the control module are integrated into the sequence control chip.

In the driving circuit of the LCD panel of the example, a purpose of the present disclosure is achieved only by regulating the time sequence of the typical data activating signal TP1, with low development difficulty. Triggering opportunities of the data output are multiple as follows:

Example 1

The sum of the delay time of the timing module and the duration time of the data activating signal is equal to the time of the overlapping time regions. The data driving chip outputs data line driving signals at the negative edge of the data activating signal. In the example, data output is triggered at the negative edge so as to ensure that the data signal is outputted when the data signal just exceeds the overlapping time regions. Thus, on the premise of preventing the data signal from overlapping in the overlapping time regions, the duration time of the data signal is supported to the largest degree. As a result, the LC molecules have more time to deflect and keep corresponding angles, to improve display quality.

Example 2

The delay time of the timing module is not less than the time of the overlapping time regions. The data driving chips output data line driving signals at the positive edge of the data activating signal. In the example, data output is triggered at the positive edge so as to ensure that the data signal is outputted when the data signal just exceeds the overlapping time regions. Thus, on the premise of preventing the data signal from overlapping in the overlapping time regions, the duration time of the data signal is supported to the largest degree. As a result, the LC molecules have more time to deflect and keep corresponding angles, to improve display quality.

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

I claim:

1. A driving circuit of a liquid crystal display (LCD) panel, comprising:

scan lines, a scan driving chip coupled to the scan lines, data lines, a data driving chip coupled to the data lines, and a data monitoring module;

the data driving chip forming simultaneously overlapping time regions between a positive edge and a negative edge of the scan lines when the data driving chip switches drive of a last row of a scan line to drive of a next row of the scan line;

wherein the data monitoring module outputs a data signal corresponding to the next row of the scan line when a time of the data signal corresponding to the last row of the scan line overlaps a time of the overlapping time regions, wherein the data monitoring module comprises a detection module, a control module, and a timing module that presets a delay time; when the detection module detects that the drive of the last row of the scan line is switched to the drive of the next row of the scan line by the scan driving chip, the timing module starts to time; when the time reaches the delay time, the control module outputs a data activating signal; the data driving chip is controlled to drive the corresponding data lines; the sum of the delay time and duration time of the data activating signal is not less than time of the overlapping time regions.

2. The driving circuit of the LCD panel of claim 1, wherein the delay time of the timing module is not less than the time of the overlapping time regions; the data driving chip outputs data line driving signals at a positive edge of the data activating signal.

3. A liquid crystal display (LCD) device, comprising:

a driving circuit of an LCD panel comprising scan lines, a scan driving chip coupled to the scan lines, data lines, a data driving chip coupled to the data lines, and a data monitoring module;

the data driving chip forming simultaneously overlapping time regions between a positive edge and a negative edge of the scan lines when the data driving chip switches drive of a last row of a scan line to drive of a next row of the scan line; wherein the data monitoring module outputs a data signal corresponding to the next row of the scan line when a time of the data signal corresponding to the last row of the scan line overlaps a time of the overlapping time regions, wherein the data monitoring module comprises a detection module, a control module, and a timing module that presets a delay time; when the detection module detects that the drive of the last row of the scan line is switched to the drive of the next row of the scan line by the scan driving chip, the timing module starts to time; when the time reaches the delay time, the control module outputs a data activating signal; the data driving chip is controlled to drive the corresponding data lines; the sum of the delay time and duration time of the data activating signal is not less than time of the overlapping time regions.

4. The LCD device of claim 3, wherein the delay time of the timing module is not less than the time of the overlapping time regions; the data driving chip outputs data line driving signals at a positive edge of the data activating signal.

* * * * *